US007115027B2

(12) United States Patent
Thomaschewski

(10) Patent No.: US 7,115,027 B2
(45) Date of Patent: Oct. 3, 2006

(54) GRINDING TOOL FOR SHARPENING WORK PIECES

(75) Inventor: Walter Thomaschewski, Filderstadt (DE)

(73) Assignee: C. & E. Fein GmbH, (DE)

( * ) Notice: Subject to any disclaimer, the term of this patent is extended or adjusted under 35 U.S.C. 154(b) by 0 days.

(21) Appl. No.: 10/813,345

(22) Filed: Mar. 30, 2004

(65) Prior Publication Data

US 2004/0253913 A1 Dec. 16, 2004

(30) Foreign Application Priority Data

Mar. 31, 2003 (DE) ..... 203 05 402 U

(51) Int. Cl.
*B24B 23/00* (2006.01)

(52) U.S. Cl. ..... 451/349; 451/357

(58) Field of Classification Search ..... 451/45, 451/121, 159, 163, 234, 270, 357, 349, 523, 451/405, 419, 441
See application file for complete search history.

(56) References Cited

U.S. PATENT DOCUMENTS

| | | | | |
|---|---|---|---|---|
| 2,087,023 | A * | 7/1937 | Reuben | 451/555 |
| 2,457,714 | A * | 12/1948 | Pancoast | 451/555 |
| 2,519,351 | A * | 8/1950 | Calvert | 451/164 |
| 2,559,273 | A * | 7/1951 | Brinkley | 76/88 |
| 2,758,431 | A * | 8/1956 | Kaufman | 451/415 |
| 2,949,709 | A * | 8/1960 | De Angelis et al. | 451/270 |
| 3,651,715 | A * | 3/1972 | Pecze et al. | 76/37 |
| 4,128,970 | A * | 12/1978 | Sawrenko | 451/356 |
| 4,202,093 | A | 5/1980 | Wallerstein | 30/169 |
| 4,989,320 | A | 2/1991 | Borkott | 30/272.1 |
| 5,209,022 | A * | 5/1993 | McCambridge | 451/461 |
| 5,363,602 | A * | 11/1994 | Anthon et al. | 451/540 |
| 5,480,507 | A | 1/1996 | Arnold | 156/344 |
| 2002/0069727 | A1* | 6/2002 | Pollak | 81/55 |
| 2002/0164935 | A1* | 11/2002 | Fletcher | 451/293 |

FOREIGN PATENT DOCUMENTS

DE 100 58 594 6/2002

OTHER PUBLICATIONS

International Search Report, Aug. 2, 2004.

* cited by examiner

*Primary Examiner*—M. Rachuba
(74) *Attorney, Agent, or Firm*—St. Onge Steward Johnston & Reens LLC

(57) ABSTRACT

A grinding tool for sharpening tools is provided comprising an oscillatory drive the output shaft of which is driven oscillatingly about its longitudinal axis. The grinding tool comprises a holder for mounting a working part which is configured as a grinding plate having a flat grinding surface. The grinding tool is held by the holder in a plane extending substantially perpendicularly to the drive shaft. The holder comprises a fixed holding section and a removable clamping part between which the working part can be clamped at one end by means of at least one tensioning part. The clamping part comprises an outer surface which serves as a guide surface for supporting a surface of the working part to adjust a preset angle between the outer surface of the clamping part and the grinding surface of the tool to be sharpened.

17 Claims, 2 Drawing Sheets

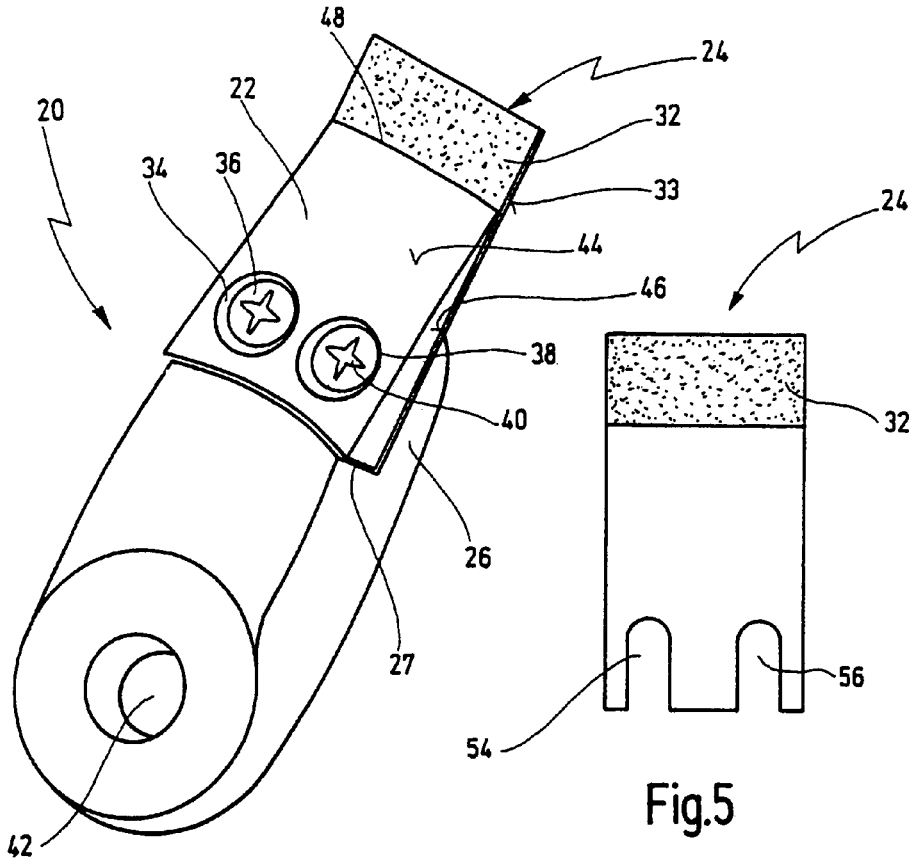
Fig.2
Fig.5
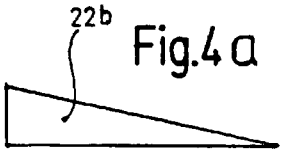
Fig.4a
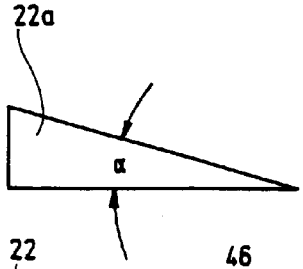
Fig.4
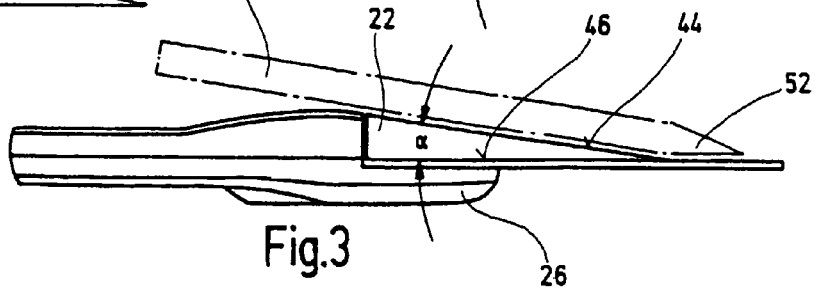
Fig.3

GRINDING TOOL FOR SHARPENING WORK PIECES

BACKGROUND OF THE INVENTION

The invention relates to a grinding tool for sharpening work pieces. More particularly, the invention relates to a grinding tool for sharpening tools, such as knifes, scissors, axes etc. using an oscillatory drive. In particular, the invention relates to a grinding tool for the sharpening of tools using a oscillatory drive the output shaft of which is driven oscillatingly about its longitudinal axis, wherein a holder is used for mounting a working part which is coated with abrasive particles, and wherein the holder comprises a fixed holding section and a removable clamping part between which the working part can be clamped at one end by means of at least one screw or the like.

A grinding tool of this kind is known from DE 100 58 894 A1.

The known tool comprises an oscillatory drive the output shaft of which can be driven oscillatingly about its longitudinal axis with a small pivot angle and at high frequency. On the output shaft of the oscillatory drive a holder is mounted which serves for mounting a working part between a fixed holding section and a removable clamping part by means of two tensioning screws. Various tools may be fixed on the holder for performing different cutting and/or grinding operations. For instance, the working part at its outer front face may have a toothed cutting edge, may be configured as a cutting knife having a sickle-shaped curvature or may for instance have a cutting edge comprising diamonds or hard metal. By means of the holder a fast exchange and a stable and stiff mounting of various working parts on the holder is ensured. Thus this tool may be used for various sawing, cutting and grinding operations.

In many cases the need arises to regrind particular cutting or sawing tools in a manner as simple and cost-effective as possible, while a preset sharpening angle shall be obtained as precisely as possible.

SUMMARY OF THE INVENTION

In view of this it is a first object of the invention to provide a grinding tool for the sharpening of work pieces.

It is a second object of the invention to provide a grinding tool for the sharpening of tools such as knifes, scissors, axes etc. using an oscillatory drive.

It is a third object of the invention to provide a grinding tool for the sharpening of work pieces having a particularly simple design.

It is a forth object of the invention to provide a grinding tool for the sharpening of work pieces allowing a precise sharpening without the need for a stationary machine.

These and other objects of the invention are achieved by a grinding tool for sharpening work pieces, such as tools, comprising an oscillatory drive the output shaft of which is driven oscillatingly about its longitudinal axis, and further comprising a holder for mounting a working part, wherein the working part is configured as a grinding plate having a flat grinding surface which is held by the holder in a plane extending substantially perpendicularly to the drive shaft, wherein the holder comprises a fixed holding section and a removable clamping part between which the working part can be clamped at one end by means of at least one tensioning part, wherein the clamping part comprises an outer surface which serves as a guide surface for supporting a surface of the working piece to define a predetermined angle between the outer surface and the grinding surface.

The object of the invention is solved complete in this way.

According to the invention a grinding tool for the sharpening of work pieces, such as tools, by means of an oscillatory drive the output shaft of which is driven oscillatingly about its longitudinal axis is provided in a particularly simple way.

Herein the adjustment of a preset sharpening angle on the tool to be sharpened is made possible by a particularly shaped clamping part which serves as a guide surface for supporting a surface of a work piece to be sharpened.

Since the grinding surface of the working part is located at a considerable distance from the drive shaft, e.g. at a distance of about 5 cm, by means of the oscillatory drive having a small pivot angle (about 0.5 to 7°) and at high frequency (about 5.000 to 30.000 oscillations per minute) a high sharpening power is reached. Also larger objects such-as axes, gardening devices and the like can be sharpened evenly in this way while requiring little power.

Naturally, in addition the grinding tool can also be utilized advantageously for performing other grinding operations or deburring operations. If for instance initially a sawing operation is performed at a location which is difficult to reach while utilizing a working part taking the form of a saw blade, then after having exchanged the working part against a grinding plate having a flat grinding surface, the same cut may subsequently be deburred.

In addition, precise sharpening operations for the sharpening of tools while keeping a preset sharpening angle can be performed, as mentioned above already.

According to a preferred development of the invention the sharpening angle $\alpha$ defined by the angle between the outer surface of the clamping part and the grinding surface is between about 10° and 40°, preferably about 15°. When utilizing a sharpening angle of 15° most of the tools known in the art can be reground precisely, such as scissors, various knives and the like.

According to another preferred development of the invention different sharpening angles can be adjusted.

To this end several clamping parts designed for different sharpening angles may be provided that can be exchanged against each other.

Apart from this, basically also the clamping part may be designed adjustable to allow a setting of different sharpening angles.

According to a further embodiment of the invention, the outer surface of the clamping part runs out in a circular arc against its inner surface facing the working part.

Herein the geometric centre of the circular arc preferably is located within a mounting opening of the holder for connecting with the drive shaft of the oscillatory drive. Thereby it is ensured that the removal rate of the grinding tool is always the same when guiding along a tool to be sharpened along the clamping part.

Thus a relatively even and precise sharpening of tools, scissors or knives is made possible also for relatively inexperienced users.

The working part taking the shape of a grinding plate may for instance comprise a grinding surface at each of its two opposite outer surfaces.

In this way, utilizing only a single grinding plate it can be worked for a relatively long time, since after wear-down of the first grinding surface the working part may simply be flipped around. Also it is possible to operate on the one hand using the guide surface of the clamping part to obtain a preset sharpening angle. On the other hand, it may also be worked directly with the grinding surface at the opposite side without using a guide surface.

Suitably, the two grinding surfaces protrude to the outside beyond the fixed holding section and beyond the clamping part.

It has been found that utilizing a diamond coarse D126 or a hard metal coating of equal value a suitable tradeoff between removal rate and quality of the surface to be cut can be reached.

It shall be understood that the features mentioned above and to be explained hereinafter cannot only be used in the given combination but also in other combinations or independently without going beyond the scope of the invention.

BRIEF DESCRIPTION OF THE DRAWINGS

Other features and advantageous of the invention can be taken from the subsequent description of preferred embodiments in conjunction with the drawings. In the drawings show:

FIG. 2 a top view of a holder comprising the clamping part and the grinding plate according to FIG. 1, seen from an inclined top view;

FIG. 3 a side view of the holder with the clamping part and the grinding plate, shown schematically together with a tool to be ground;

FIG. 4 a side view of a different clamping part having a larger sharpening angle α; and FIG. 4*a* is a side view of another clamping part having a sharpening angle that is different from the angle α of clamping element 22*a* shown in FIG. 4, which can be used as an exchanging part thereof to provide different sharpening angles by replacing;

FIG. 5 a top view of the grinding plate according to FIG. 2.

DETAILED DESCRIPTION OF THE PREFERRED EMBODIMENTS

Figure 1:
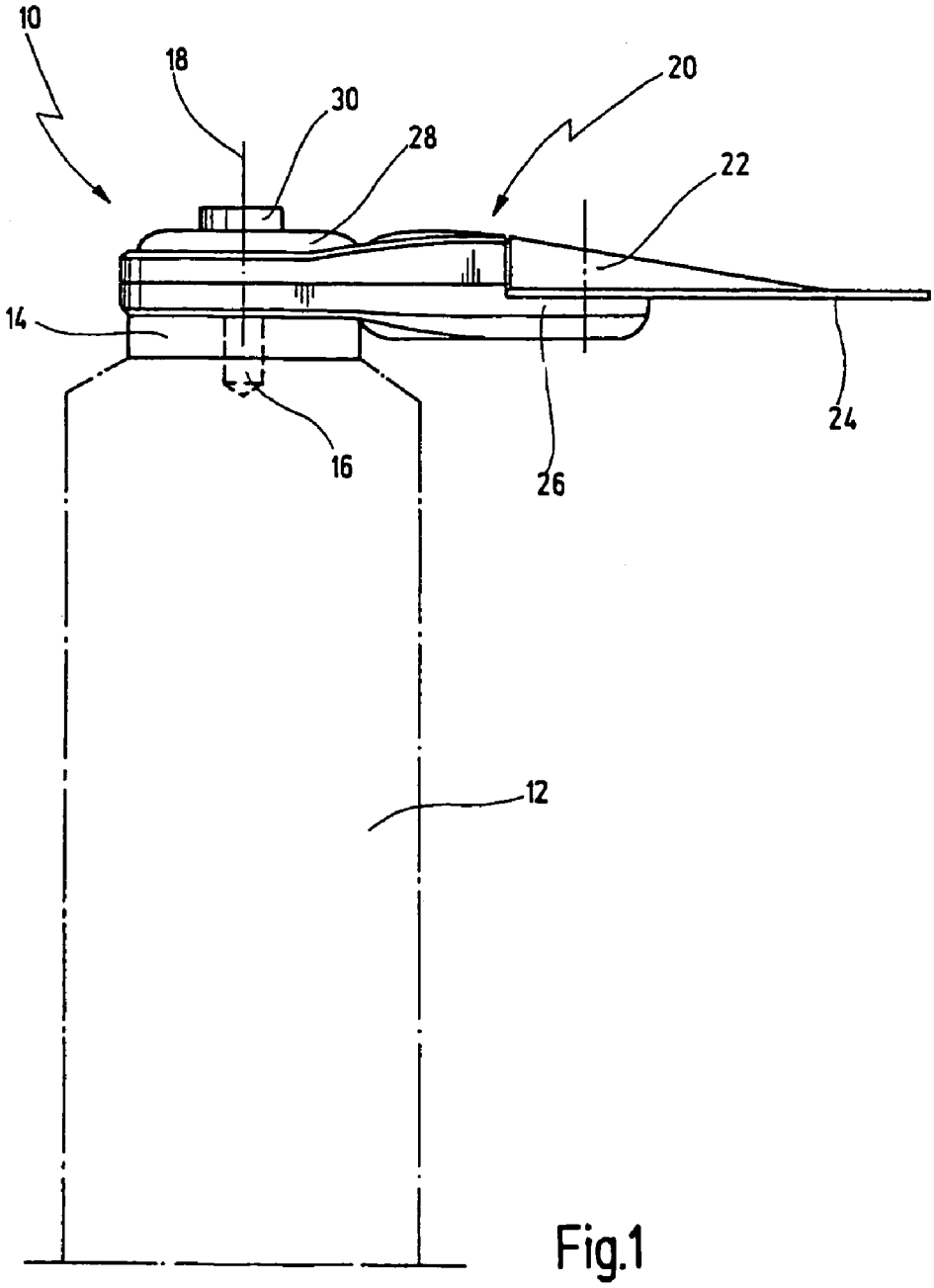
FIG. 1 a side view of a grinding tool according to the invention, wherein the related oscillatory drive is depicted only schematically.

In FIG. 1 a grinding tool according to the invention is depicted in total with numeral 10. The grinding tool comprises an oscillatory drive 12, shown merely schematically, driving a drive shaft 14 about its longitudinal axis 18 back and forth in an oscillating manner, wherein a small pivot angle of e.g. 0.5 to 5° and a high frequency of about 5.000 to 30.000 oscillations per minute is reached.

Such oscillatory drives are known in the art and are used for instance for severing an adhesive bead on a wind screen while using a suitable shaped cutting knife, in case the wind screen must be exchanged due to some kind of damage. In addition, such oscillatingly driven tools have been found to be advantageous for various operations. To this end various sawing tools of longitudinal, circular or partially circular shape, grinding tools of particular shape are known as well as cutting tools in the form of particularly shaped cutting knives.

According to FIG. 1 a holder designated in total with 20 is mounted on the output shaft 14 of the oscillatory drive 12 using a clamping disk 28 and a clamping screw 30 which is screwed centrally into a threaded dead bore 16.

Now a working part 24 may be mounted removably to the holder 20 between a fixed holding section 26 and a clamping part 22. Herein the working part 24 may for instance be clamped at its first end between the fixed holding sections 26 and the clamping part 22 by means of tensioning elements, e.g. being designed as clamping screws, while the other end protrudes to the outside beyond the holding section 26 and beyond the clamping part 22, respectively.

Such a design is basically known from DE 100 58 894 A1.

The grinding tool 10 according to the invention differs from the grinding tool known in the art by the fact that the clamping part 22 comprises an outer surface being designed as a guide surface for resting against a surface of a tool for adjusting a preset angle between the outer surface and the grinding surface. In addition, the working part 24 comprises a particular coating comprising diamonds or hard metal, preferably on both sides, to allow a sharpening of tools at a preset sharpening angle and to allow filing and deburring operations.

Further details will now be given with reference to FIGS. 2 to 5.

The holder 20 at its end opposite the working part 24 comprises a mounting opening 42 through which the mounting screw 30 can be screwed into the output shaft 14 of oscillatory drive 12 while inserting the clamping disk 28 there between. Within the outer region of the holder 20 a recess of rectangular cross-section is formed which is limited by the surface of a fixed holding section 26 at its lower side and is limited at its side facing the mounting opening 42 by a front surface 27 extending perpendicularly thereto.

For mounting the working part 24, basically being designed flat, is put onto the surface of the fixed holding section 26 and is secured after attaching the clamping part 22 by screwing two tensioning screws 36, 40 through oblong holes 54, 56 of the working part 24 (cf. FIG. 5) into threads assigned thereto within the fixed holding section 26. Preferably, the two clamping screws 36, 40 are received sunk-in within the respective recesses 34, 38 of the clamping part 22.

The outer surface 44 of the clamping part 22 with the inner surface 46 facing the fixed holding section 26 runs together at an acute angle α and ends into the surface of the working part 24 by a partially circular arc 48.

If now the grinding tool 10 is set with the outer surface 44 of the clamping part 22 against a surface of the tool 50 according to FIG. 3, then the outer surface 44 of the clamping part 22 serves as a guide surface. In this way between the flat grinding surface 32 at the side facing the tool 50 and between the outer surface 44 of the clamping part 22 an angle α can be maintained, so that a cutting edge 52 on the outer end of the tool 50 to be sharpened can be sharpened exactly with this sharpening angle α.

It will be understood that depending on the tool to be sharpened different clamping parts 20 or 22*a*, respectively, having different sharpening angles α and being exchangeable, may be utilized.

In this way, different sharpening angles α can be adjusted which, preferably, are in a range between about 10° and 40°. As a basic design a clamping part 22 having an angle α of about 15° is preferred, since this is one of the most common sharpening angles of various knives, scissors and other tools. Naturally however, also other sharpening angles can be preset by exchanging the clamping part, such as shown for example by using clamping part 22*a* according to FIG. 4.

In addition, it is conceived to use a clamping part of adjustable design.

As mentioned above, the outer surface 44 of the clamping part 22 runs together with the inner surface 46 in a circular arc 48 (cf. FIG. 2). The centre of this circular arc 48 is located in the centre of the mounting opening 42. Thereby it is ensured that the removal rate of the grinding surface 32 is always kept the same when guiding the tool to be sharpened along the outer surface 44 of the clamping part 22. Thereby a relatively even and precise sharpening of tools and cutting knives is made possible.

The working part 24 taking the shape of the grinding plate is made of metal and is suitably designed on both outer sides with grinding surfaces 32 and 33, respectively. On the grinding surfaces either diamond abrasive particles or hard metal abrasive particles are received within a suitable binding layer.

It has been found that using a diamond coarse grit or a hard metal coating of similar quality a suitable tradeoff between removal rate and quality of the surface to be ground can be reached.

The clamping element 22 or 22*a*, respectively, preferably is made of plastic (as Well as the holder). Herein by using a suitable material match an abutment against the outer surface of the clamping element of a tool to be sharpened (usually consisting of steel) is made possible with low friction.

What is claimed is:

1. A hand-held grinding tool for sharpening a work piece comprising:

an oscillatory drive having a drive shaft which is driven oscillatingly back and forth about a longitudinal axis thereof;

a holder for mounting a working part being configured as a grinding plate having a flat grinding surface;

a fixed holding section provided on said holder and a removable clamping part provided on said holder for clamping said working part at one end thereof between said fixed holding section and said removable clamping part; and at least one tensioning part for fixing said working part between said fixed holding section and said removable clamping part of said holder in a position so that said grinding surface extends in a plane substantially perpendicularly to said drive shaft;

wherein said clamping part has a generally triangular cross section comprising an outer surface which serves as a guide surface for supporting a surface of said work piece to define a predetermined angle between said surface of said work piece and said grinding surface of said working part when guiding said grinding tool along said surface of said work piece for sharpening said work piece;

wherein said predetermined angle is between 10° and 40°.

2. The grinding tool of claim 1, wherein said predetermined angle is about 15°.

3. The grinding tool of claim 1, wherein said clamping part comprises an outer surface that ends toward said flat grinding surface in a partially circular arc when said working part is clamped between said holding section and said clamping part.

4. The grinding tool of claim 3, wherein said holder comprises a mounting opening for mounting said grinding tool on said drive shaft of said oscillatory drive.

5. The grinding tool of claim 4, wherein said circular arc defines a centre which is located within a centre of said mounting opening.

6. The grinding tool of claim 1, wherein said grinding plate comprises two outer surfaces each of which is configured as a grinding surface.

7. The grinding tool of claim 6, wherein said two grinding surfaces protrude to the outside beyond said fixed holding section and beyond said clamping part.

8. The grinding tool of claim 1, wherein said working part comprises at least one grinding surface having a coating comprising diamond abrasive particles.

9. The grinding tool of claim 1, wherein said working part comprises at least one grinding surface having a coating comprising hard metal abrasive particles.

10. The grinding tool of claim 1, wherein said holding section of said holder comprises threaded holes for receiving tensioning parts configured as screws.

11. The grinding tool of claim 10, wherein said clamping part comprises recesses configured for receiving screws in a sunk-in configuration.

12. A hand-held grinding tool for sharpening a work piece comprising:

an oscillatory drive having a drive shaft which is driven oscillatingly about a longitudinal axis thereof;

a holder for mounting a working part being configured as a grinding plate having a flat grinding surface;

a fixed holding section provided on said holder and a removable clamping part provided on said holder for clamping said working part at one end thereof between said fixed holding section and said removable clamping part; and at least one tensioning part for fixing said working part between said fixed holding section and said removable clamping part of said holder in a position so that said grinding surface extends in a plane substantially perpendicularly to said drive shaft;

wherein said clamping part comprises an outer surface which serves as a guide surface for supporting a surface of said work piece to define a predetermined angle between said surface of said work piece and said grinding surface of said working part when guiding said grinding tool along said surface of said work piece for sharpening said work piece;

wherein said grinding tool comprises a plurality of different clamping parts designed for different predetermined angles and being exchangeable so as to allow a setting of the predetermined angle.

13. The grinding tool of claim 12, wherein said predetermined angle is between 10° and 40°.

14. A holder in a grinding tool for sharpening a work piece using a hand-held oscillatory drive having a drive shaft which is driven oscillatingly back and forth about a longitudinal axis thereof, wherein:

said holder is configured for mounting a working part to said drive shaft of said oscillatory drive, said working part being configured as a grinding plate having a flat grinding surface;

said holder comprises a fixed holding section and a removable clamping part for clamping said working part at one end thereof between said fixed holding section and said removable clamping part;

said holder comprises at least one tensioning part for fixing said working part between said fixed holding section and said removable clamping part of said holder in a position so that said grinding surface extends in a plane substantially perpendicularly to said drive shaft;

wherein said clamping part has a generally triangular cross section comprising an outer surface which serves as a guide surface for supporting a surface of said work piece to define a preset angle between said surface of said work piece and said grinding surface of said working part when guiding said grinding tool along said surface of said work piece for sharpening said work piece; and wherein said preset angle is between 10° and 40°.

15. The holder of claim 14, wherein said grinding surface protrudes beyond said outer surface of said clamping part.

16. A hand-held grinding tool for sharpening a work piece comprising:

an oscillatory drive having a drive shaft which is driven oscillatingly back and forth about a longitudinal axis thereof;

a holder for mounting a working part being configured as a grinding plate having a flat grinding surface;

a fixed holding section provided on said holder and a removable clamping part provided on said holder for clamping said working part at one end thereof between said fixed holding section and said removable clamping part;

at least one tensioning part for fixing said working part between said fixed holding section and said removable clamping part of said holder in a position so that said grinding surface extends in a plane substantially perpendicularly to said drive shaft;

wherein said clamping part has a generally triangular cross section comprising an outer surface which serves as a guide surface for supporting a surface of said work piece to define a predetermined angle between said surface of said work piece and said grinding surface of said working part when guiding said grinding tool along said surface of said work piece for sharpening said work piece;

and wherein said grinding surface protrudes beyond said outer surface of said clamping part.

17. The grinding tool of claim 16, wherein said predetermined angle is between 10° and 40°.

* * * * *